US009650690B2

(12) United States Patent
Yamamoto et al.

(10) Patent No.: US 9,650,690 B2
(45) Date of Patent: May 16, 2017

(54) HIGH-STRENGTH STEEL SHEET AND METHOD OF PRODUCING MOLTEN STEEL FOR HIGH-STRENGTH STEEL SHEET

(75) Inventors: Kenichi Yamamoto, Tokyo (JP); Katsuhiro Sasai, Tokyo (JP); Hideaki Yamamura, Tokyo (JP); Hiroshi Harada, Tokyo (JP); Kaoru Kawasaki, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 821 days.

(21) Appl. No.: 12/736,998

(22) PCT Filed: Jun. 15, 2009

(86) PCT No.: PCT/JP2009/060880

§ 371 (c)(1),
(2), (4) Date: Nov. 29, 2010

(87) PCT Pub. No.: WO2009/151140

PCT Pub. Date: Dec. 17, 2009

(65) Prior Publication Data

US 2011/0076512 A1 Mar. 31, 2011

(30) Foreign Application Priority Data

Jun. 13, 2008 (JP) ..... 2008-155655

(51) Int. Cl.

| | |
|---|---|
| ***C22C 38/04*** | (2006.01) |
| ***C21C 7/00*** | (2006.01) |
| ***C21C 7/06*** | (2006.01) |
| ***C22C 38/00*** | (2006.01) |
| ***C22C 38/02*** | (2006.01) |
| ***C22C 38/14*** | (2006.01) |

(52) U.S. Cl.

CPC ..... *C21C 7/0006* (2013.01); *C21C 7/06* (2013.01); *C22C 38/001* (2013.01); *C22C 38/02* (2013.01); *C22C 38/04* (2013.01); *C22C 38/14* (2013.01); *Y10T 428/1266* (2015.01)

(58) Field of Classification Search

CPC ..... C22C 38/14; C22C 38/02; C22C 38/04; C21C 7/06

USPC ..... 148/331

See application file for complete search history.

(56) References Cited

U.S. PATENT DOCUMENTS

| | | | | |
|---|---|---|---|---|
| 3,925,111 | A * | 12/1975 | Takechi et al. | 148/602 |
| 6,120,578 | A * | 9/2000 | Nakato et al. | 75/568 |
| 6,221,180 | B1 * | 4/2001 | Tosaka et al. | 148/320 |
| 9,238,848 | B2 | 1/2016 | Suwa et al. | |
| 2007/0079910 | A1 * | 4/2007 | Sasai et al. | 148/546 |
| 2009/0238714 | A1 | 9/2009 | Arai et al. | |
| 2009/0277545 | A1 | 11/2009 | Yamasaki et al. | |
| 2011/0076512 | A1 | 3/2011 | Yamamoto et al. | |

FOREIGN PATENT DOCUMENTS

| | | | |
|---|---|---|---|
| CA | 2727224 | A1 | 12/2009 |
| CA | 2768825 | A1 | 2/2011 |
| CN | 1875124 | A | 12/2006 |
| CN | 101490295 | A | 7/2009 |
| JP | 58-210125 | | 12/1983 |
| JP | 11-199973 | | 7/1999 |
| JP | 2001-026842 | A | 1/2001 |
| JP | 2001-200331 | | 7/2001 |
| JP | 2002-309313 | | 10/2002 |
| JP | 2002-363694 | A | 12/2002 |
| JP | 2003-171734 | | 6/2003 |
| JP | 2004-195522 | | 7/2004 |
| JP | 2004-256906 | | 9/2004 |
| JP | 2004-315900 | A | 11/2004 |
| JP | 2005-002441 | A | 1/2005 |
| JP | 2005-256115 | | 9/2005 |
| JP | 2005-307301 | | 11/2005 |
| JP | 2006-131943 | | 5/2006 |
| JP | 2007-146280 | | 6/2007 |
| JP | 2008-274336 | A | 11/2008 |
| JP | 2009-299136 | A | 12/2009 |
| JP | 2009-299137 | A | 12/2009 |
| JP | 4431185 | B2 | 3/2010 |

(Continued)

OTHER PUBLICATIONS

Machine translation of JP 2007-146280 (Japanese document published on Jun. 14, 2007).*

International Search Report dated Sep. 8, 2009 issued in corresponding PCT Application No. PCT/JP2009/060880.

European Search Report dated Feb. 18, 2014 issued in corresponding EP Application No. 09762566.9.

International Search Report dated May 29, 2012 in corresponding PCT Application No. PCT/JP2012/054384 [English Translation of Search Report].

(Continued)

*Primary Examiner* — Jesse Roe

*Assistant Examiner* — Christopher Kessler

(74) *Attorney, Agent, or Firm* — Birch, Stewart, Kolasch & Birch, LLP

(57) ABSTRACT

A high-strength steel sheet includes: 0.03 to 0.20% of C, 0.08 to 1.5% of Si, 0.5 to 3.0% of Mn, 0.05% or less of P, 0.0005% or more of S, 0.008 to 0.20% of acid-soluble Ti, 0.0005 to 0.01% of N, more than 0.01% of acid-soluble Al, and 0.001 to 0.04% of one or both of Ce and La in terms of mass %; and the balance including Fe and inevitable impurities. The ratio of (Ce+La)/acid-soluble Al is equal to or more than 0.1 and the ratio of (Ce+La)/S is in the range of 0.4 to 50 in a mass base, and the density of the number of inclusions, having a circle equivalent diameter of 2 μm or less, which are present in the steel sheet is equal to or more than 15/mm$^2$.

14 Claims, No Drawings

(56) References Cited

FOREIGN PATENT DOCUMENTS

JP 2011-032572 A 2/2011

OTHER PUBLICATIONS

Office Action dated Jul. 2, 2014 issued in corresponding Chinese Application No. 201280002655.1 [with English Translation of Search Report].

Office Action dated Aug. 14, 2014 issued in corresponding Canadian Application No. 2808458.

Office Action dated Sep. 17, 2015 issued in U.S. Appl. No. 13/817,042.

Office Action dated Apr. 22, 2016 issued in U.S. Appl. No. 13/817,042.

Office Action issued in related Brazilian Application No. PI0912834-4 on Feb. 7, 2014 with English language translation.

* cited by examiner

HIGH-STRENGTH STEEL SHEET AND METHOD OF PRODUCING MOLTEN STEEL FOR HIGH-STRENGTH STEEL SHEET

TECHNICAL FIELD OF THE INVENTION

The present invention relates to a high-strength steel sheet which is suitable for an underbody part of transport machines and the like, and more particularly, to a high-strength steel sheet having excellent stretch-flange formability and fatigue properties and a method of producing molten steel for the high-strength steel sheet.

This application is a national stage application of International Application No. PCT/JP2009/060880, filed Jun. 15, 2009, which claims priority to is claimed on Japanese Patent Application No. 2008-155655, filed on Jun. 13, 2008, the content of which is incorporated herein by reference.

BACKGROUND ART

There is an increasing demand for an increase in strength and a reduction in weight of automotive hot rolled steel sheets from the viewpoint of the improvement in fuel efficiency linked to improvements in automobile safety and protection of the environment. Particularly, the mass of frames and arms, which are referred to as underbody systems among automotive parts, constitute a large part of the total mass of a vehicle. So, a material which is used for such parts is processed to have an increased strength and thereby to be thinner, and in this manner, the reduction in vehicle weight can be achieved. Moreover, the material which is used for the underbody systems requires high fatigue properties from the viewpoint of durability relating to the oscillation while the vehicle is running, and thus high-strength steel sheets are widely used. Among them, hot rolled steel sheets are mainly used for the reason of price advantage.

Among the hot rolled steel sheets, there are known low-yield ratio DP steel sheets in which a ferrite phase and a martensite phase are combined and TRIP steel sheets in which a ferrite phase and an (remaining) austenitic phase are combined as steel sheets having both a high strength and good workability and formability. However, while these steel sheets have a high strength and excellent workability and ductility, they cannot be said to have excellent hole expansibility, that is, stretch-flange formability. In the case of constituent parts requiring stretch-flange formability, such as underbody parts, bainite steel sheets are generally used despite their slightly poor ductility.

A considerable reason for the poor stretch-flange formability of composite structure steel sheets such as a composite structure steel sheet (hereinafter, may be described as "DP steel sheet") formed from a ferrite phase and a martensite phase is that, since the composite structure steel sheets are composite bodies of a soft ferrite phase and a hard martensite phase, stress is concentrated at the boundary parts between both the phases in hole expansion and the boundary parts thus easily become the starting points of fracture due to failing to follow deformations.

In order to overcome the problem, there are proposed several steel sheets, in which a DP steel sheet serves as a base for the purpose of achieving both mechanical strength characteristics and fatigue properties or hole expansibility (workability). For example, in Patent Document 1, as a technique for the stress relaxation achieved by dispersed fine grains, a steel sheet is disclosed in which fine Cu is precipitated or solid solution is dispersed in a composite structure steel sheet (DP steel sheet) formed from a ferrite phase and a martensite phase. In the technique shown in Patent Document 1, it is found that, the solid-soluted Cu or the Cu precipitate in which the size of grains consisting of only Cu is equal to or smaller than 2 nm is very effective in improving fatigue properties and also does not damage workability, and then, composition ratios of various compositions are limited.

In addition, as a technique for the stress relaxation achieved by reducing a strength difference between combined phases, for example, Patent Document 2 discloses a technique in which by reducing the content of C as much as possible, a bainite structure is employed for a main phase and a ferrite structure subjected to solid solution strengthening or precipitation strengthening is included at a proper volume ratio to reduce the difference in hardness between the ferrite and the bainite and to avoid the generation of coarse carbides.

PRIOR ART DOCUMENT

Patent Document

[Patent Document 1] Japanese Unexamined Patent Application, First Publication No. H11-199973

[Patent Document 2] Japanese Unexamined Patent Application, First Publication No. 2001-200331

DISCLOSURE OF THE INVENTION

Problem to be Solved by the Invention

The steel sheet in which fine Cu is precipitated or solid solution is dispersed in the DP steel sheet, as disclosed in the above Patent Document 1, surely exhibits high fatigue strength, but the remarkable improvement in stretch-flange formability cannot be confirmed. In addition, the high-strength hot rolled steel sheet, the structure of which includes a bainite phase as a main portion to suppress the generation of coarse carbides, as disclosed in the above Patent Document 2, surely exhibits excellent stretch-flange formability, but fatigue properties thereof cannot necessarily be said to be excellent in comparison with those of the DP steel sheet containing Cu. Further, by merely suppressing the generation of coarse carbides, it is not possible to prevent the generation of cracks when severe hole expansion processing is performed. According to the study of the present inventors, it was found that a cause of the problems is presence of extended sulfide-based inclusions including MnS as a main portion in the steel sheet.

That is, when undergoing repetitive deformation, internal defects are generated around the extended coarse MnS-based inclusions, which are present in the surface layer or therearound, and are propagated as cracks. Accordingly, since the defects deteriorate fatigue properties and easily become a starting point of cracking in hole expansion, the defects are a cause of the reduction in stretch-flange formability.

However, Mn is an element effectively contributing to the increase in strength of a material together with C and Si. Accordingly, in general, the concentration of Mn is set to a high value to ensure the strength in a high-strength steel sheet. Moreover, in general steel making, about 50 ppm of S is also included. Therefore, in general, MnS is present in a cast piece. In addition, when soluble Ti is increased at the same time, it partially combines with coarse TiS or MnS, so (Mn, Ti)S is precipitated. When the cast piece is hot-rolled or cold-rolled, such MnS-based inclusions are easily deformed, so they become the extended MnS-based inclusions and are a cause of the reduction in fatigue properties and stretch-flange formability (hole expansion workability). However, no examples can be shown for proposing a high-strength steel sheet, having excellent stretch-flange formability and fatigue properties, viewed from the viewpoint of the controls of the precipitation and deformation of the MnS-based inclusions, and a method of producing molten steel for the high-strength steel sheet.

The invention is contrived in view of the above-described problems and an object of the invention is to provide a high-strength steel sheet, having excellent stretch-flange formability and fatigue properties, in which fine MnS, TiS and (Mn, Ti)S precipitated in a cast piece are dispersed as fine spherical inclusions, which do not undergo deformation in rolling and do not easily become a starting point of cracking in the steel sheet, so as to improve the stretch-flange formability and the fatigue properties, and a method of producing molten steel for the high-strength steel sheet.

Means for Solving the Problem

In order to solve the problems as described above, the present inventors have conducted intensive study on a method for improving stretch-flange formability by precipitating fine MnS, TiS and (Mn, Ti)S (in the invention, the 3 inclusions, that is, MnS, TiS and (Mn, Ti)S are referred to as MnS-based inclusions for convenience) in a cast piece and dispersing the inclusions as fine spherical inclusions which do not undergo deformation in rolling and do not easily become a starting point of cracking in the steel sheet, and on the clarification of additional elements which do not deteriorate fatigue properties.

As a result, it was clarified that, since MnS, TiS and (Mn, Ti)S are precipitated on fine and hard Ce oxides, La oxides, cerium oxysulfide and lanthanum oxysulfide generated by the deoxidation which is carried out by adding Ce and La and the precipitated MnS, TiS and (Mn, Ti)S are not easily deformed even in rolling, the extended coarse MnS is markedly reduced in the steel sheet, and the MnS-based inclusions do not easily become a starting point of cracking or a route of crack propagation in repetitive deformation or hole expansion and thus this leads to the improvement in resistance to fatigue and the like as described above. Further, it was clarified that carrying out the 3-step sequential deoxidation which includes, first, carrying out the deoxidation with Si, subsequently carrying out the deoxidation with Al, subsequently adding Ti, and finally carrying out the deoxidation by adding Ce and/or La, in order to obtain the fine oxides and MnS-based inclusions is linked to the miniaturization of the oxides generated in each step and is thus effective.

An example is also observed in which MnS-based inclusions and TiN are compositely precipitated on fine and hard Ce oxides, La oxides, cerium oxysulfide and lanthanum oxysulfide. However, it is confirmed that TiN has little influence on stretch-flange formability and fatigue properties, so TiN is not an object of the MnS-based inclusion.

Moreover, it was found that through increasing acid-soluble Ti in steel by adding Ti, crystal grains can be miniaturized by an effect of the pinning of carbonitrides of Ti or solid solution Ti. Accordingly, it was found that since the MnS-based inclusions in the steel can be formed in a fine spherical shape while not extended as much as possible and the crystal grains can also be miniaturized, both high fatigue properties and excellent stretch-flange formability can be achieved.

The gist of a high-strength steel sheet having excellent stretch-flange formability and fatigue properties according to the invention is as follows.

(1) A high-strength steel sheet including: 0.03 to 0.20% of C, 0.08 to 1.5% of Si, 0.5 to 3.0% of Mn, 0.05% or less of P, 0.0005% or more of S, 0.008 to 0.20% of acid-soluble Ti, 0.0005 to 0.01% of N, more than 0.01% of acid-soluble Al, and 0.001 to 0.04% of one or both of Ce and La in terms of mass %; and the balance including Fe and inevitable impurities, wherein the ratio of (Ce+La)/acid-soluble Al is equal to or more than 0.1 and the ratio of (Ce+La)/S is in the range of 0.4 to 50 in a mass base, and wherein the density of the number of inclusions, having a circle equivalent diameter of 2 μm or less, which are present in the steel sheet is equal to or more than $15/mm^2$.

(2) A high-strength steel sheet including: 0.03 to 0.20% of C, 0.08 to 1.5% of Si, 0.5 to 3.0% of Mn, 0.05% or less of P, 0.0005% or more of S, 0.008 to 0.20% of acid-soluble Ti, 0.0005 to 0.01% of N, more than 0.01% of acid-soluble Al, and 0.001 to 0.04% of one or both of Ce and La in terms of mass %; and the balance including Fe and inevitable impurities, wherein the ratio of (Ce+La)/acid-soluble Al is equal to or more than 0.1 and the ratio of (Ce+La)/S is in the range of 0.4 to 50 in a mass base, and wherein the ratio of the number of extended inclusions, having a circle equivalent diameter of 1 μm or more and the ratio of long axis/short axis of 5 or more, which are present in the steel sheet is equal to or less than 20%.

(3) A high-strength steel sheet including: 0.03 to 0.20% of C, 0.08 to 1.5% of Si, 0.5 to 3.0% of Mn, 0.05% or less of P, 0.0005% or more of S, 0.008 to 0.20% of acid-soluble Ti, 0.0005 to 0.01% of N, more than 0.01% of acid-soluble Al, and 0.001 to 0.04% of one or both of Ce and La in terms of mass %; and the balance including Fe and inevitable impurities, wherein the ratio of (Ce+La)/acid-soluble Al is equal to or more than 0.1 and the ratio of (Ce+La)/S is in the range of 0.4 to 50 in a mass base, and wherein in the steel sheet, inclusions, where at least one of MnS, TiS and (Mn, Ti)S is compositely precipitated on oxides including one or both of Ce and La, or oxides or oxysulfide including one or both of Ce and La with one or both of Si and Ti contained therein, are included at a number ratio of 10% or more.

(4) A high-strength steel sheet including: 0.03 to 0.20% of C, 0.08 to 1.5% of Si, 0.5 to 3.0% of Mn, 0.05% or less of P, 0.0005% or more of S, 0.008 to 0.20% of acid-soluble Ti, 0.0005 to 0.01% of N, more than 0.01% of acid-soluble Al, and 0.001 to 0.04% of one or both of Ce and La in terms of mass %; and the balance including Fe and inevitable impurities, wherein the ratio of (Ce+La)/acid-soluble Al is equal to or more than 0.1 and the ratio of (Ce+La)/S is in the range of 0.4 to 50 in a mass base, and wherein a volume number density of extended inclusions, having a circle equivalent diameter of 1 μm or more and a ratio of long axis/short axis of 5 or more, which are present in the steel sheet is equal to or less than $1.0\times10^4/mm^3$.

(5) A high-strength steel sheet including: 0.03 to 0.20% of C, 0.08 to 1.5% of Si, 0.5 to 3.0% of Mn, 0.05% or less of P, 0.0005% or more of S, 0.008 to 0.20% of acid-soluble Ti, 0.0005 to 0.01% of N, more than 0.01% of acid-soluble Al, and 0.001 to 0.04% of one or both of Ce and La in terms of mass %; and the balance including Fe and inevitable impurities, wherein the ratio of (Ce+La)/acid-soluble Al is equal to or more than 0.1 and the ratio of (Ce+La)/S is in the range of 0.4 to 50 in a mass base, and wherein in the steel sheet, a volume number density of inclusions, where at least one of MnS, TiS and (Mn, Ti)S is compositely precipitated on oxides including one or both of Ce and La, or oxides or oxysulfide including one or both of Ce and La with one or both of Si and Ti contained therein, is equal to or more than $1.0\times10^3/mm^3$.

(6) A high-strength steel sheet including: 0.03 to 0.20% of C, 0.08 to 1.5% of Si, 0.5 to 3.0% of Mn, 0.05% or less of P, 0.0005% or more of S, 0.008 to 0.20% of acid-soluble Ti, 0.0005 to 0.01% of N, more than 0.01% of acid-soluble Al, and 0.001 to 0.04% of one or both of Ce and La in terms of mass %; and the balance including Fe and inevitable impurities, wherein the ratio of (Ce+La)/acid-soluble Al is equal to or more than 0.1 and the ratio of (Ce+La)/S is in the range of 0.4 to 50 in a mass base, and wherein an average circle equivalent diameter of extended inclusions, having a circle equivalent diameter of 1 μm or more and a ratio of long axis/short axis of 5 or more, which are present in the steel sheet is equal to or less than 10 μm.

(7) A high-strength steel sheet including: 0.03 to 0.20% of C, 0.08 to 1.5% of Si, 0.5 to 3.0% of Mn, 0.05% or less of P, 0.0005% or more of S, 0.008 to 0.20% of acid-soluble Ti, 0.0005 to 0.01% of N, more than 0.01% of acid-soluble Al, and 0.001 to 0.04% of one or both of Ce and La in terms of mass %; and the balance including Fe and inevitable impurities, wherein the ratio of (Ce+La)/acid-soluble Al is equal to or more than 0.1 and the ratio of (Ce+La)/S is in the range of 0.4 to 50 in a mass base, and wherein in the steel sheet, inclusions, where at least one of MnS, TiS and (Mn, Ti)S is compositely precipitated on oxides including one or both of Ce and La, or oxides or oxysulfide including one or both of Ce and La with one or both of Si and Ti contained therein, are present, and 0.5 to 95 mass % of one or both of Ce and La is contained in the inclusions in average composition.

(8) A high-strength steel sheet including: 0.03 to 0.20% of C, 0.08 to 1.5% of Si, 0.5 to 3.0% of Mn, 0.05% or less of P, 0.0005% or more of S, 0.008 to 0.20% of acid-soluble Ti, 0.0005 to 0.01% of N, more than 0.01% of acid-soluble Al, and 0.001 to 0.04% of one or both of Ce and La in terms of mass %; and the balance including Fe and inevitable impurities, wherein the ratio of (Ce+La)/acid-soluble Al is equal to or more than 0.1 and the ratio of (Ce+La)/S is in the range of 0.4 to 50 in a mass base, and wherein an average crystal grain size of the structure of the steel sheet is equal to or less than 10 μm.

(9) The high-strength steel sheet according to any one of (1) to (8), further containing: one or both of 0.01 to 0.10% of Nb and 0.01 to 0.05% of V in terms of mass %.

(10) The high-strength steel sheet according to any one of (1) to (9), further containing: at least one of 0.01 to 0.6% of Cr, 0.01 to 0.4% of Mo and 0.0003 to 0.003% of B in terms of mass %.

(11) The high-strength steel sheet according to any one of (1) to (10), further containing: one or both of 0.0001 to 0.004% of Ca and 0.001 to 0.01% of Zr in terms of mass %.

(12) A method of producing molten steel for the high-strength steel sheet according to any one of (1) to (11), the method including: performing an adding or adjusting operation so that 0.03 to 0.20% of C, 0.08 to 1.5% of Si, 0.5 to 3.0% of Mn and 0.0005 to 0.01% of N are present in the molten steel which is processed to contain 0.05% or less of P and 0.0005% or more of S; adding Al so that more than 0.01% of acid-soluble Al is present; adding Ti; and adding one or both of Ce and La so that 0.008 to 0.20% of acid-soluble Ti and 0.001 to 0.04% of one or both of Ce and La are present in terms of mass % in a refining step in steel making, wherein the ratio of (Ce+La)/acid-soluble Al is equal to or more than 0.1 and the ratio of (Ce+La)/S is in the range of 0.4 to 50 in a mass base.

(13) The method according to (12), further including: performing an adding operation before adding one or both of Ce and La so that one or both of 0.01 to 0.10% of Nb and 0.01 to 0.05% of V are present in terms of mass % in the refining step.

(14) The method according to (12) or (13), further including: performing an adding operation before adding one or both of Ce and La so that at least one of 0.01 to 0.6% of Cr, 0.01 to 0.4% of Mo and 0.0003 to 0.003% of B are present in terms of mass % in the refining step.

(15) The method according to any one of (12) to (14), further including: performing an adding operation before adding one or both of Ce and La so that one or both of 0.0001 to 0.004% of Ca and 0.001 to 0.01% of Zr are present in terms of mass % in the refining step.

The high-strength steel sheet in the invention may be used as itself as a usual hot rolled or cold rolled steel sheet or may be used after being subjected to a surface process such as plating or coating.

Effect of the Invention

In a high-strength steel sheet according to the invention, by the Al deoxidation, the adjustment of components in molten steel is stabilized, the generation of coarse alumina inclusions is suppressed and fine MnS-based inclusions are precipitated in the cast piece. So, the fine spherical inclusions, which do not undergo deformation in rolling and do not easily become a starting point of cracking, can be dispersed in the steel sheet. In addition, it is possible to make crystal grains in the structure fine and improve stretch-flange formability and fatigue properties.

Moreover, in a method of producing molten steel for the above-described high-strength steel sheet according to the invention, by the Al deoxidation, the adjustment of components in the molten steel is stabilized, the generation of coarse alumina inclusions can be suppressed and fine MnS-based inclusions are precipitated in the cast piece. So, the fine spherical inclusions, which do not undergo deformation in rolling and do not easily become a starting point of cracking, can be dispersed in the steel sheet. In addition, it is possible to make crystal grains in the structure fine and obtain a high-strength hot rolled steel sheet having excellent stretch-flange formability and fatigue properties.

EMBODIMENT OF THE INVENTION

Hereinafter, a high-strength steel sheet having excellent stretch-flange formability and fatigue properties will be described in detail as a best mode for carrying out the invention. Mass % in composition will be simply denoted by the sign %.

First, experiments for achieving the invention will be described.

The present inventors carried out a deoxidation process of molten steel containing 0.06% of C, 0.7% of Si, 1.4% of Mn, 0.01% or less of P, 0.005% of S, 0.003% of N and the balance Fe by using various elements to produce a steel ingot. The obtained steel ingot was hot-rolled to produce 3 mm thick hot rolled steel sheets. The produced hot rolled steel sheets were subjected to a tensile test, a hole expansion test and a fatigue test. In addition, a density of the number of inclusions in a steel sheet, a form and an average composition were examined.

First, Si was added. Then, almost completely carrying out the deoxidation without using Al, Ti was added and stirring was performed for about 2 minutes. After that, one or both of Ce and La were added to perform the deoxidization and the stretch-flange formability and the fatigue properties of the steel sheet were examined. As a result, it was confirmed that the stretch-flange formability and the fatigue properties can be improved in the steel sheet subjected to the sequential deoxidation in 3 steps using Si, Ti and one or both of Ce and La. This is because, since MnS-based inclusions such as MnS, TiS and (Mn, Ti)S are precipitated on fine and hard Ce oxides, La oxides, cerium oxysulfide and lanthanum oxysulfide, which are generated by the deoxidation carried out by adding Ce and La, and the deformation of the precipitated MnS-based inclusions can be suppressed even in rolling, the extended coarse MnS-based inclusions can be markedly reduced in the steel sheet. Moreover, TiN grains are also generated because of the addition of Ti, and this contributes to the exhibition of a so-called pinning function suppressing the growth of crystal grains in the structure of the steel sheet in the heating which is performed before the rolling. Thus, the size of the crystal grains in the steel sheet structure also is fine. As a result, in repetitive deformation or hole expansion, the MnS-based inclusions do not easily become a starting point of cracking or a route of crack propagation, and the coarse MnS-based inclusions, causing the deterioration of fatigue properties in the past, can be prevented from being generated in the steel sheet as much as possible. In addition, it is thought that this is because the fine crystal grain size of the steel sheet structure leads to the improvement in resistance to fatigue and the like, as described above.

The reason for the miniaturization of the Ce oxides, La oxides, cerium oxysulfide and lanthanum oxysulfide is that: fine Ti oxides are generated by reducing and decomposing $SiO_2$-based inclusions, which are generated by the initial Si deoxidation, with Ti which is added afterward, and the reductive decomposition is then further carried out with Ce and La to form the fine Ce oxides, La oxides, cerium oxysulfide and lanthanum oxysulfide; and interfacial energy between the molten steel and the formed Ce oxides, La oxides, cerium oxysulfide and lanthanum oxysulfide is low, and the aggregation of the inclusions after the generation is thus suppressed.

In this manner, when almost completely carrying out the deoxidation without using Al, markedly excellent material characteristics were obtained. Instead of Al, the deoxidation is carried out with Ti, Ce and La and there is a need to increase input amounts of Ti, Ce and La in order to realize the desired deoxidation. However, when the deoxidation is carried out with Ti, Ce and La, an oxygen potential is higher than in the Al deoxidation. Thus, upon adjusting the components in the molten steel, a variation in a target composition is increased, so it is found that a problem may occur in that it is difficult to obtain desired chemical components.

Accordingly, subsequently, while carrying out the Al deoxidation, the present inventors changed the composition of Ti, Ce and La and carried out the deoxidation to produce a steel ingot. The obtained steel ingot was hot-rolled to produce 3 mm thick hot rolled steel sheets. The produced hot rolled steel sheets were subjected to a hole expansion test and a fatigue test. In addition, a density of the number of inclusions in a steel sheet, a form and an average composition were examined.

Through the experiment, a result was obtained in which an oxygen potential in the molten steel is rapidly reduced if a predetermined ratio of (Ce+La)/acid-soluble Al and a predetermined ratio of (Ce+La)/S were obtained in a mass base in molten steel deoxidized by adding Si, carrying out the deoxidation with Al, adding Ti, adding one or both of Ce and La. That is, the oxygen potential was most reduced by the effect of the composite deoxidation with Al, Si, Ti, Ce and La among a plurality of deoxidations carried out with various deoxidation elements. Also, regarding oxides to be generated, the concentration of $Al_2O_3$ can be minimized by the effect of the composite deoxidation, so it is found that a steel sheet is obtained which has excellent stretch-flange formability and fatigue properties as in the steel sheet produced almost completely carrying out the deoxidation without using Al.

The reason for this is thought to be as follows.

That is, $SiO_2$ inclusions are generated upon adding Si and then the $SiO_2$ inclusions are reduced to Si by adding Al. Al reduces the $SiO_2$ inclusions and deoxidizes the dissolved oxygen in the molten steel so as to generate $Al_2O_3$-based inclusions. A portion of the $Al_2O_3$-based inclusions is floated so as to be removed and the remaining $Al_2O_3$-based inclusions remain in the molten steel. After that, Ti is added. However, at this time, the oxygen in the molten steel has already been deoxidized with Al and thus there is a small amount of deoxidation due to Ti. Further, with Ce and La which are added afterward, the $Al_2O_3$-based inclusions are reduced and decomposed to form fine Ce oxides, La oxides, cerium oxysulfide and lanthanum oxysulfide. In this manner, by the composite deoxidation carried out by adding Al, Si, Ti, Ce and La, fine and hard Ce oxides, La oxides, cerium oxysulfide, lanthanum oxysulfide and Ti oxides are thought to be generated which occupying the majority although a slight amount of $Al_2O_3$ remains.

Accordingly, in the composite deoxidation which is carried out by adding Al, Si, Ti, Ce and La, by properly carrying out the Al deoxidation on the basis of the above-described deoxidation method, MnS, TiS or (Mn, Ti)S can be precipitated on the fine and hard Ce oxides, La oxides, cerium oxysulfide, lanthanum oxysulfide and Ti oxides as in the case in which the Al deoxidation is rarely carried out, and the deformation of the precipitated MnS-based inclusions (MnS, TiS, (Mn, Ti)S) can be suppressed even in rolling. Therefore, an effect is obtained in which the extended coarse MnS-based inclusions can be markedly reduced in the steel sheet and fatigue properties and the like can thus be improved, and it is newly found that a variation in component composition can be reduced because the oxygen potential of the molten steel can be reduced by the Al deoxidation.

On the basis of the knowledge obtained from the experimental examinations, the present inventors examined conditions of chemical components of a steel sheet as follows and achieved the invention.

Hereinafter, the reasons for limiting the chemical components in the invention will be described.

C: 0.03~0.20%

C is the most basic element for controlling the hardening ability and the strength of steel, and increases the hardness and the depth of a hardened layer to effectively contribute to the improvement in fatigue properties. That is, C is an element necessary for ensuring the strength of a steel sheet, and at least 0.03% of C is required to obtain a high-strength steel sheet. However, when C is excessively included and the concentration thereof exceeds 0.20%, workability and weldability deteriorate. In the invention, the concentration of C is equal to or less than 0.20% in order to ensure workability and weldability.

Si: 0.08~1.5%

Si is an important deoxidation element. Si increases the number of nucleation sites of austenite in quenching so as to suppress the growth of austenite grains and functions to miniaturize the grain size of a hardened layer. Since Si suppresses the generation of carbides so as to suppress the reduction in grain boundary strength which is caused by the carbides, and is effective in generating a bainite structure, Si is an important element for improving a strength without largely damaging stretch and improving hole expansibility at a low yield strength ratio. In order to reduce the concentration of dissolved oxygen in molten steel and generate $SiO_2$-based inclusions (in order to generate alumina-based inclusions by reducing the $SiO_2$-based inclusions with Al which is added afterward and to reduce the alumina-based inclusions with Ce and La), it is necessary to add 0.08% or more of Si. Accordingly, in the invention, the lower limit for Si is set to 0.08%. On the other hand, when the concentration of Si is too high, the concentration of $SiO_2$ in the inclusions increases and thus large inclusions are easily generated. Therefore, it is hard to carry out the reduction using Al. Moreover, toughness and ductility markedly deteriorate and the chance of surface decarburization or surface scratching is thus increased, so fatigue properties deteriorate. In addition, when Si is excessively added, weldability and ductility are affected. Accordingly, in the invention, the upper limit for Si is set to 1.5%.

Mn: 0.5~3.0%

Mn is an element useful in deoxidation in a net manufacturing step and is effective in increasing the strength of a steel sheet together with C and Si. In order to obtain such effects, it is necessary to contain 0.5% or more of Mn. However, when Mn more than 3.0% is contained, ductility is reduced due to the increase of solid solution strengthening or the segregation of Mn. Moreover, since weldability and base material toughness also deteriorate, the upper limit of Mn is set to 3.0%.

P: 0.05% or less

P is effective from the viewpoint that P acts as a substitution solid solution strengthening element which is smaller than a Fe atom. However, when the concentration of P exceeds 0.05%, it segregates at austenite grain boundaries and grain boundary strength is reduced. Therefore, it may become a cause of the reduction in torsional fatigue strength and the deterioration in workability. Accordingly, the upper limit is set to 0.05%. When there is no need for solid solution strengthening, it is not necessary to add P, so the lower limit of P includes 0%.

S: 0.0005% or more

S segregates as inevitable impurities. Since S forms extended coarse MnS-based inclusions and thus deteriorates stretch-flange formability, it is desirable that the concentration thereof is very low. In the past, it was necessary to extremely lower the concentration of S to ensure stretch-flange formability. However, for lowering the concentration of S to less than 0.0005% so as to improve the material of a steel sheet, a desulfurization load in secondary refining is too large, and thus a desulfurization cost is increased and an appropriate material cannot be obtained. Accordingly, assuming the desulfurization in secondary refining, the lower limit of the concentration of S is set to 0.0005%.

In the present invention, MnS-based inclusions are precipitated on inclusions such as fine and hard Ce oxides, La oxides, cerium oxysulfide and lanthanum oxysulfide and the form of the MnS-based inclusions is thus controlled, so the deformation does not easily occur even in rolling and the extension of the inclusions is prevented. Accordingly, the upper limit of the concentration of S is defined depending on the relationship with the total amount of one or both of Ce and La, as described later.

That is, in the present invention, as described above, the form of MnS is controlled by the inclusions such as Ce oxides, La oxides, cerium oxysulfide and lanthanum oxysulfide. Therefore, even when the concentration of S is high, by adding one or both of Ce and La in an amount corresponding to the concentration, it is possible to prevent the material from being affected. That is, even when the concentration of S is high to some extent, by adjusting an additional amount of Ce or La corresponding to the concentration, a substantial desulfurization effect is obtained and the same material as extra-low sulfur steel is obtained. In other words, by properly adjusting the total amount of Ce and/or La and S, the degree of freedom in regard to the upper limit of the concentration of S can be increased. Accordingly, in the present invention, there is no need to carry out molten steel desulfurization in secondary refining for obtaining extra-low sulfur steel and the molten steel desulfurization may be omitted. Therefore, the production process can be simplified and the desulfurization processing cost can be reduced as a result.

Acid-soluble Ti: 0.008~0.20%

Ti is an important deoxidation element and forms carbides, nitrides and carbonitrides. Through sufficient heating before hot rolling, Ti increases the number of nucleation sites of austenite so as to suppress the growth of austenite grains, and thus it contributes to the miniaturization and the increase in strength, effectively acts on dynamic recrystallization in hot rolling and functions to markedly improve stretch-flange formability. It was experimentally found that it is necessary to add 0.008% or more of acid-soluble Ti to achieve this. Accordingly, in the invention, the lower limit of acid-soluble Ti is set to 0.008%.

In addition, a temperature of the sufficient heating before hot rolling is required to be sufficient to solid-solute the carbides, nitrides and carbonitrides generated in casting and it is necessary that the temperature is higher than 1200° C. Setting a high temperature higher than 1250° C. is not preferable from the viewpoint of cost and the generation of scale. Accordingly, the temperature is preferably set to about 1250° C.

On the other hand, when acid-soluble Ti of more than 0.2% is contained, an effect on deoxidation is saturated, and the coarse carbides, nitrides and carbonitrides are formed even when heating is sufficiently performed before hot rolling. Thus, the material deteriorates and an effect appropriate to the content cannot be expected. Accordingly, in the invention, the upper limit of the concentration of acid-soluble Ti is set to 0.2%.

In addition, the concentration of acid-soluble Ti is obtained by measuring the concentration of Ti dissolved in an acid and an analysis method is used employing the fact that dissolved Ti is dissolved in an acid and Ti oxides are not dissolved in the acid. Herein, the acid can be exemplified by a mixed acid in which, for example, a hydrochloric acid, a nitric acid and water are mixed at a ratio of 1:1:2 (mass ratio). By using such an acid, Ti which is soluble in the acid can be separated from Ti oxides which are not soluble in the acid and the concentration of acid-soluble Ti can be measured.

N: 0.0005~0.01%

N is an element which is inevitably mixed in steel because the nitrogen in the air is fed during the molten steel process. N forms nitrides together with Al and Ti so as to prompt increased fineness of the structure of the base material. However, when N of more than 0.01% is contained, N generates coarse precipitates together with Al and Ti and deteriorates stretch-flange formability. Accordingly, in the invention, the upper limit of the concentration of N is set to 0.01%. On the other hand, when the concentration of N is less than 0.0005%, cost increases, so the lower limit of the concentration of N is set to 0.0005% from the viewpoint of industrial feasibility.

Acid-soluble Al: More than 0.01%

In general, regarding acid-soluble Al, oxides thereof are clustered and thereby easily become coarse, and deteriorate stretch-flange formability and fatigue properties. Therefore, it is desirable that the concentration thereof is suppressed as low as possible. However, in the present invention, by a composite deoxidation effect of Si, Ti, Ce and La and by setting the concentration of Ce and La corresponding to the concentration of acid-soluble Al although carrying out the Al deoxidation, as described above, a portion of $Al_2O_3$-based inclusions generated through the Al deoxidation is floated so as to be removed and the remaining $Al_2O_3$-based inclusions in molten steel are reduced and decomposed with Ce and La which are added afterward, and thus an area is newly found in which the fine inclusions are formed and the alumina-based oxides are not clustered and thereby do not become coarse.

Accordingly, in the present invention, it is not necessary to establish a limit such that Al is not substantially added as in the past, and particularly, the degree of freedom in the concentration of acid-soluble Al can be increased. By setting the concentration of acid-soluble Al more than 0.01%, the Al deoxidation can be carried out in combination with the deoxidation carried out by the addition of Ce and La and it is not necessary to add a larger amount of Ce and La than necessary, as was required for the deoxidation as in the past. A problem can be solved in that an oxygen potential in steel is increased due to the deoxidation using Ce and La, and a variation in composition of each constituent element can also be suppressed.

The upper limit of the concentration of acid-soluble Al is defined depending on the relationship with the total amount of one or both of Ce and La, as described later.

In addition, the concentration of acid-soluble Al is obtained by measuring the concentration of Al dissolved in an acid and an analysis method is used employing the fact that dissolved Al is dissolved in an acid and $Al_2O_3$ is not dissolved in the acid. Herein, the acid can be exemplified by a mixed acid in which, for example, a hydrochloric acid, a nitric acid and water are mixed at a ratio of 1:1:2 (mass ratio). By using such an acid, Al which is soluble in the acid can be separated from $Al_2O_3$ which is not soluble in the acid and the concentration of acid-soluble Al can be measured.

One or Both of Ce and La: 0.001~0.04%

Ce and La reduce $SiO_2$ generated by the Si deoxidation and $Al_2O_3$ sequentially generated by the Al deoxidation, and are effective in forming, as a main phase (50% or more as a rule of thumb), inclusions having Ce oxides (For example, $Ce_2O_3$, $CeO_2$), cerium oxysulfide (for example, $Ce_2O_2S$), La oxides (for example, $La_2O_3$, $LaO_2$), lanthanum oxysulfide (for example, $La_2O_2S$), Ce oxide-La oxides or cerium oxysulfide-lanthanum oxysulfide, which easily become precipitation sites of MnS-based inclusions and are hard, fine and resistant to deformation during rolling.

Herein, in the inclusions, MnO, $SiO_2$, $TiO_2$, $Ti_2O_3$ or $Al_2O_3$ is sometimes partially contained in accordance with a deoxidation condition. However, when the main phase is the above oxides, they sufficiently function as precipitation sites of MnS-based inclusions and do not impair the miniaturization and hardening effects of the inclusions.

It was experimentally found that it is necessary to set the concentration of one or both of Ce and La in the range of 0.0005% to 0.04%.

When the concentration of one or both of Ce and La is less than 0.0005%, $SiO_2$ and $Al_2O_3$ inclusions cannot be reduced. On the other hand; when the concentration of one or both of Ce and La exceeds 0.04%, large amounts of cerium oxysulfide and lanthanum oxysulfide are generated and become coarse inclusions, so stretch-flange formability and fatigue properties are deteriorated.

Further, attention was paid to the fact that, as a condition of the presence of inclusions where MnS is precipitated on oxides or oxysulfide including one or both of Ce and La in the above-described steel sheet of the invention, understanding the level of modification of MnS with oxides or oxysulfide including one or both of Ce and La can be defined using the concentration of S, and it was conceived that this is defined and explained with a mass ratio of Ce+La to S, which are the chemical components of the steel sheet. Specifically, when the mass ratio is small, oxides or oxysulfide including one or both of Ce and La exist only in a small amount and a large amount of MnS is separately precipitated. When the mass ratio is large, oxides or oxysulfide including one or both of Ce and La exist in larger amounts than MnS, so inclusions are increased where MnS is precipitated on oxides or oxysulfide including one or both of Ce and La. That is, MnS is modified with the oxides or oxysulfide including one or both of Ce and La. In this manner, in order to improve stretch-flange formability and fatigue properties, MnS is precipitated on oxides or oxysulfide including one or both of Ce and La and this leads to the prevention of the extension of MnS. Accordingly, the above-described mass ratio can be explained as a parameter for identifying whether these effects are exhibited or not.

Accordingly, in order to clarify the chemical component ratio effective in suppressing the extension of MnS-based inclusions, the mass ratio of (Ce+La)/S of the steel sheet was changed to evaluate the form of the inclusions, stretch-flange formability and fatigue properties. As a result, it was found that both stretch-flange formability and fatigue properties are remarkably improved when the mass ratio of (Ce+La)/S is in the range of 0.4 to 50.

When the mass ratio of (Ce+La)/S is less than 0.4, a ratio of the number of inclusions where MnS is precipitated on oxides or oxysulfide including one or both of Ce and La is too small, and thus a ratio of the number of extended MnS-based inclusions which easily become a starting point of cracking is too large. Accordingly, stretch-flange formability and fatigue properties are reduced.

On the other hand, when the mass ratio of (Ce+La)/S is more than 50, an effect of improving stretch-flange formability and fatigue properties by precipitating MnS on cerium oxysulfide and lanthanum oxysulfide is saturated. Accordingly, the mass ratio of (Ce+La)/S of more than 50 is not appropriate from the viewpoint of cost. From the above result, the mass ratio of (Ce+La)/S is limited in the range of 0.4 to 50. In addition, when the mass ratio of (Ce+La)/S is too large and exceeds, for example, 70, large amounts of cerium oxysulfide and lanthanum oxysulfide are generated and become coarse inclusions, so stretch-flange formability and fatigue properties are deteriorated. From this, the upper limit of the mass ratio of (Ce+La)/S is set to 50.

Hereinafter, regarding selected elements, reasons for limiting the chemical components will be described. Since these elements are selected elements, the addition of the elements is arbitrarily determined. One or more kinds may be added.

Regarding Nb and V, Nb and V form carbides, nitrides and carbonitrides together with C or N to prompt increased fineness of the structure of the base material and contribute to the improvement in toughness.

Nb: 0.01~0.10% It is preferable that the concentration of Nb is set to 0.01% or more so as to obtain the above-described composite carbides and composite nitrides. However, even if Nb is included in a large amount exceeding 0.10%, the effect of increasing fineness of the structure of the base material is saturated and production cost increases. Accordingly, the upper limit of the concentration of Nb is set to 0.10%.

V: 0.01~0.05%

It is preferable that the concentration of V is set to 0.01% or more so as to obtain the above-described composite carbides and composite nitrides. However, even if V is included in a large amount exceeding 0.05%, the effect is saturated and production cost increases. Accordingly, the upper limit of the concentration of V is set to 0.05%.

Cr, Mo and B improve the hardening ability of steel.

Cr: 0.01~0.6%

Cr may be contained as necessary to ensure the strength of steel. In order to obtain the effect, it is preferable that 0.01% or more of Cr is added. However, when a large amount of Cr is contained, the balance between strength and ductility deteriorates. Accordingly, the upper limit is set to 0.6%.

Mo: 0.01~0.4%

Mo may be contained as necessary to ensure the strength of steel. In order to obtain the effect, it is preferable that 0.01% or more of Mo is added. However, when a large amount of Mo is contained, the balance between strength and ductility deteriorates. Accordingly, the upper limit is set to 0.4%.

B: 0.0003~0.003%

B may be contained as necessary to strengthen grain boundaries and improve workability. In order to obtain these effects, it is preferable that 0.0003% or more of B is added. However, even if a large amount of B exceeding 0.003% is included, the effects are saturated, the cleanliness of steel is damaged and ductility deteriorates. Accordingly, the upper limit is set to 0.003%.

Regarding Ca and Zr,

Ca and Zr strengthen grain boundaries by controlling the form of sulfides, and may be contained as necessary to improve workability.

Ca: 0.0001~0.004%

Ca controls the form of desulfurization, such as spheroidizing sulfides, to strengthen grain boundaries and improve the workability of steel. In order to obtain these effects, it is preferable that an additional amount of Ca is set to 0.0001% or more. However, even if a large amount of Ca is included, the effects are saturated, the cleanliness of steel is damaged and ductility deteriorates. Accordingly, the upper limit is set to 0.004%.

Zr: 0.001~0.01%

It is preferable that 0.001% or more of Zr is added to obtain an effect of improving toughness of the base material by spheroidizing the above-described sulfides. However, when a large amount of Zr is contained, the cleanliness of steel is damaged and ductility deteriorates. Accordingly, the upper limit is set to 0.01%.

Next, conditions of the presence of the inclusions in the steel sheet of the invention will be described. The steel sheet which will be described herein is a sheet after rolling, obtained through hot rolling or further cold rolling. The conditions of the presence of the inclusions in the steel sheet of the present invention are defined from various viewpoints.

In order to obtain a steel sheet having excellent stretch-flange formability and fatigue properties, it is important to reduce as much as possible the extended coarse MnS-based inclusions, which easily become a starting point of cracking or a route of crack propagation in the steel sheet.

The present inventors found that even in the case in which Si is added and the deoxidation is then carried out with Al as described above, in a steel sheet deoxidized by subsequently adding Ti and one or both of Ce and La, when the above-described ratio of (Ce+La)/acid-soluble Al and ratio of (Ce+La)/S are obtained in a mass base, an oxygen potential in molten steel is rapidly reduced by the composite deoxidation and the concentration of $Al_2O_3$ as generated inclusions is reduced, and thus the steel sheet has excellent stretch-flange formability and fatigue properties as in the steel sheet produced almost completely carrying out the deoxidation without using Al.

In addition, it was also found that by the deoxidation carried out by adding Ce and La, MnS is precipitated on fine and hard Ce oxides, La oxides, cerium oxysulfide and lanthanum oxysulfide which are generated to occupy the majority although a slight amount of $Al_2O_3$ is included, and the precipitated MnS is not easily deformed even in rolling, so the extended coarse MnS is markedly reduced in the steel plate.

It was found that when the above-described ratio of (Ce+La)/acid-soluble Al and ratio of (Ce+La)/S are obtained in a mass base, the density of the number of fine inclusions having a circle equivalent diameter of 2 μm or less is rapidly increased and the fine inclusions are dispersed in the steel.

Since the fine inclusions are hard to be aggregated, the shape thereof is almost spherical or fusiform. When the shape is expressed by a ratio of long axis/short axis (hereinafter, may be described as "extension ratio"), the ratio is equal to or less than 3, and preferably equal to or less than 2.

In an experiment, the identification is easily performed by the observation using a scanning electron microscope (SEM) or the like. Further, attention was paid to the density of the number of the inclusions having a circle equivalent diameter of 2 μm or less. The lower limit of the circle equivalent diameter is not particularly limited, but it is preferable that the inclusions with a size of about 0.5 μm or more are employed as an object to be counted on a number basis. Herein, the circle equivalent diameter is defined as $(\text{long axis} \times \text{short axis})^{0.5}$ from the long and short axes of the inclusions, the cross-section of which has been observed.

The details of the mechanism is not clear, but it is though that a synergistic effect of the reduction of an oxygen potential of molten steel caused by the Al deoxidation and the miniaturization of MnS-based inclusions leads to the dispersion of the fine inclusions of 2 μm or less at a ratio of 15 inclusions/$mm^2$. Accordingly, a mechanism for relaxing the stress concentration occurring during stretch-flange forming and the like is operated and it is inferred that the operation gives an effect of rapidly improving hole expansibility. As a result, in repetitive deformation or hole expansion, the MnS-based inclusions do not easily become a starting point of cracking or a route of crack propagation, and contribute to the relaxation of stress concentration since the inclusions are fine. In addition, it is though that the inclusions lead to the improvement in stretch-flange formability and fatigue properties.

Meanwhile, the present inventors examined whether the extended coarse MnS-based inclusions (MnS, TiS and (Mn, Ti)S inclusions) which easily become a starting point of cracking or a route of crack propagation can be reduced in the steel sheet.

Through an experiment, the present inventors found that, in the case of MnS having a circle equivalent diameter less than 1 μm, MnS is harmless as a starting point of cracking and does not deteriorate stretch-flange formability and fatigue properties even while extended. In addition, from the fact that inclusions having a circle equivalent diameter of 1 μm or more are easily observed by a scanning electron microscope (SEM) or the like, the present inventors employed, as an object, inclusions having a circle equivalent diameter of 1 μm or more in a steel plate to examine the form and the composition thereof and evaluate the distribution state of the extended MnS.

The upper limit of the circle equivalent diameter of MnS is not particularly limited, but in reality, MnS of about 1 mm is sometimes observed.

As for the ratio of the number of the extended inclusions, the composition of plural inclusions (for example, about 50 inclusions), having a circle equivalent diameter of 1 μm or more, randomly selected using a SEM is analyzed and the long and short axes of the inclusions are measured from a SEM image. Herein, the extended inclusions are defined as inclusions having a ratio of long axis/short axis (extension ratio) of 5 or more and the detected number of the extended inclusions is divided by the total number of the examined inclusions (about 50 inclusions in the case of the above-described example) to obtain the ratio of the number of the extended inclusions.

The reason the extension ratio is set to 5 or more is that inclusions having an extension ratio of 5 or more in a comparative steel sheet in which Ce and La are not added are almost MnS. The upper limit of the extension ratio of MnS is not particularly limited, but in reality, MnS having an extension ratio of about 50 is sometimes observed.

As a result, it was found that in a steel sheet in which the form is controlled so that the ratio of the number of extended inclusions having an extension ratio of 5 or more is 20% or less, stretch-flange formability and fatigue properties are improved. That is, when the ratio of the number of extended inclusions having an extension ratio of 5 or more exceeds 20%, the ratio of the number of extended MnS-based inclusions which easily become a starting point of cracking is too large, so stretch-flange formability and fatigue properties are reduced. Accordingly, in the invention, the ratio of the number of extended inclusions having an extension ratio of 5 or more is equal to or less than 20%.

The fewer the extended MnS-based inclusions, the better the stretch-flange formability and fatigue properties. Accordingly, the lower limit of the ratio of the number of extended inclusions having an extension ratio of 5 or more includes 0%. Herein, the above description that the lower limit of the ratio of the number of extended inclusions having a circle equivalent diameter of 1 μm or more and an extension ratio of 5 or more is 0% refers to the case of inclusions having a circle equivalent diameter of 1 μm or more but not having an extension ratio of 5 or more and the case of extended inclusions having an extension ratio of 5 or more but having a circle equivalent diameter less than 1 μm.

Moreover, since the largest circle equivalent diameter of the extended inclusions is confirmed to be smaller than an average crystal grain size of the structure, it is thought that this is a cause of the remarkable improvement in stretch-flange formability and fatigue properties.

Further, in a steel sheet in which the form is controlled so that the ratio of the number of extended inclusions having a mass ratio of (Ce+La)/S of 0.4 to 50 and an extension ratio or 5 or more is equal to or less than 20%, in accordance with this, a form is employed in which MnS-based inclusions are precipitated on oxides including one or both of Ce and La, or oxides or oxysulfide including one or both of Ce and La with one or both of Si and Ti contained therein. The inclusions preferably has the form where MnS-based inclusions are precipitated on oxides including one or both of Ce and La, or oxides or oxysulfide including one or both of Ce and La with one or both of Si and Ti contained therein. The form is not particularly limited, but in many cases, oxides including one or both of Ce and La, or oxides or oxysulfide including one or both of Ce and La with one or both of Si and Ti contained therein are set as nuclei and MnS-based inclusions are precipitated therearound.

The MnS-based inclusions and TiN are sometimes compositely precipitated on fine and hard Ce oxides, La oxides, cerium oxysulfide and lanthanum oxysulfide. However, as described above, it is confirmed that TiN has little influence on stretch-flange formability and fatigue properties, and thus TiN is not an object of the MnS-based inclusions of the present invention.

Since the inclusions where MnS-based inclusions are precipitated on oxides including one or both of Ce and La, or oxides or oxysulfide including one or both of Ce and La with one or both of Si and Ti contained therein are not easily deformed even in rolling, the inclusions have a shape which is not extended in the steel sheet, that is, have a spherical or fusiform shape.

Herein, the spherical inclusions which are determined to be not extended are not particularly limited. However, the inclusions are inclusions having an extension ratio of 3 or less, preferably 2 or less. This is because at the stage of cast piece before rolling, the extension ratio of the inclusions where MnS-based inclusions are precipitated on oxides including one or both of Ce and La, or oxides or oxysulfide including one or both of Ce and La with one or both of Si and Ti contained therein is 3 or less. Further, if spherical inclusions which are determined to be not extended are completely spherical, the extension ratio is 1, so the lower limit of the extension ratio is 1.

The ratio of the number of these inclusions was examined in the same manner as in the examination of the ratio of the number of extended inclusions. As a result, it was found that in a steel sheet in which the precipitation is controlled so that the ratio of the number of the inclusions where MnS-based inclusions are precipitated on oxides or oxysulfide including one or both of Ce and La is equal to or more than 10%, stretch-flange formability and fatigue properties are improved. When the ratio of the number of the inclusions where MnS-based inclusions are precipitated on oxides or oxysulfide including one or both of Ce and La is less than 10%, the ratio of the number of the extended inclusions of MnS is too large, so stretch-flange formability and fatigue properties are reduced. Accordingly, the ratio of the number of the inclusions where MnS-based inclusions are precipitated on oxides or oxysulfide including one or both of Ce and La is set to 10% or more. Stretch-flange formability and fatigue properties are excellent when a number of MnS-based inclusions are precipitated on oxides or oxysulfide including one or both of Ce and La. Therefore, the upper limit of the ratio of the number of the inclusions includes 100%.

Since the inclusions where MnS-based inclusions are precipitated on oxides including one or both of Ce and La, or oxides or oxysulfide including one or both of Ce and La with one or both of Si and Ti contained therein are not easily deformed even in rolling, the circle equivalent diameter of the inclusions is not particularly limited. The diameter may be equal to or more than 1 μm. However, when the diameter is too large, there is concern that the inclusions may be a starting point of cracking, so the upper limit is preferably set to about 50 μm.

Since these inclusions are not easily deformed even in rolling, and the inclusions do not become a starting point of cracking if the circle equivalent diameter thereof is less than 1 μm, the lower limit of the circle equivalent diameter is not particularly limited.

Next, as a condition of the presence of the inclusions in the above-described steel sheet of the present invention, a number density of inclusion per unit volume is defined.

A grain size distribution of inclusions was obtained by SEM evaluation of an electrolyzed surface by a speed method. The SEM evaluation of the electrolyzed surface by the speed method means that the surface of a sample piece is polished and is then electrolyzed by the speed method and the sample surface is directly observed by an SEM to evaluate the size and the number density of the inclusions. The speed method is a method of using 10% acetyl acetone-1% tetramethyl ammonium chloride-methanol to electrolyze a sample surface and extract inclusions, and 1 C per 1 $cm^2$ area of the sample surface was electrolyzed as an amount of electrolysis. An SEM image of the thus electrolyzed surface was subjected to image processing so as to obtain the distribution of frequency (number) with respect to the circle equivalent diameter. From this distribution of frequency of the grain size, an average circle equivalent diameter was calculated. Further, the frequency was divided by the area of the observed field and the depth obtained from the amount of electrolysis, so as to calculate the number density of inclusions per volume.

As a result of the evaluation on the volume number density of inclusions, having a circle equivalent diameter of 1 μm or more and an extension ratio of 5 or more, which become a starting point of cracking and deteriorate stretch-flange formability and fatigue properties, it was found that stretch-flange formability and fatigue properties are improved when the volume number density is equal to or less than $1.0\times10^4/mm^3$. When the volume number density of extended inclusions having a circle equivalent diameter of 1 μm or more and an extension ratio of 5 or more exceeds $1.0\times10^4/mm^3$, the number density of the extended MnS-based inclusions which easily become a starting point of cracking is too large and stretch-flange formability and fatigue properties are thus reduced. Accordingly, the volume number density of the extended inclusions having a circle equivalent diameter of 1 μm or more and an extension ratio of 5 or more is set to $1.0\times10^4/mm^3$ or less. Further, the fewer the extended MnS-based inclusions, the better the stretch-flange formability and fatigue properties. Accordingly, the lower limit of the volume number density of the extended inclusions having a circle equivalent diameter of 1 μm or more and an extension ratio of 5 or more includes 0%.

Herein, the above description that the lower limit of the volume number density of the extended inclusions having a circle equivalent diameter of 1 μm or more and an extension ratio of 5 or more is 0% has the same meaning as described above.

Further, in a steel sheet in which the form is controlled so that the volume number density of extended inclusions having a diameter of 1 μm or more and an extension ratio of 5 or more is $1.0\times10^4/mm^3$ or less, in accordance with this, unextended MnS-based inclusions have the form where MnS-based inclusions are precipitated on oxides including one or both of Ce and La, or oxides or oxysulfide including one or both of Ce and La with one or both of Si and Ti contained therein. The shape of the unextended MnS-based inclusions was almost spherical or fusiform.

In the same manner as above, it is preferable that the inclusions have the form where MnS-based inclusions are precipitated on oxides including one or both of Ce and La, or oxides or oxysulfide including one or both of Ce and La with one or both of Si and Ti contained therein, and the form is not particularly limited. However, in many cases, oxides including one or both of Ce and La, or oxides or oxysulfide including one or both of Ce and La with one or both of Si and Ti contained therein are set as nuclei and MnS-based inclusions are precipitated therearound.

The fusiform inclusions are not particularly limited. However, the inclusions have an extension ratio of 3 or less, and preferably 2 or less in the steel sheet. Herein, when the inclusions have a completely spherical shape, the extension ratio is 1, so the lower limit of the extension ratio is 1.

As a result of the examination about the volume number density of the inclusions, it was found that stretch-flange formability and fatigue properties are improved in a steel sheet in which the precipitation is controlled so that the volume number density of inclusions where MnS-based inclusions are precipitated around oxides including one or both of Ce and La, or oxides or oxysulfide including one or both of Ce and La with one or both of Si and Ti contained therein, set as nuclei, is equal to or more than $1.0\times10^3/mm^3$. When the volume number density of inclusions where MnS-based inclusions are precipitated on oxides including one or both of Ce and La, or oxides or oxysulfide including one or both of Ce and La with one or both of Si and Ti contained therein is less than $1.0\times10^3/mm^3$, the ratio of the number of the MnS-based inclusions is too large and stretch-flange formability and fatigue properties are thus reduced. Accordingly, the volume number density of the inclusions where MnS-based inclusions are precipitated on oxides including one or both of Ce and La, or oxides or oxysulfide including one or both of Ce and La with one or both of Si and Ti contained therein is defined to $1.0\times10^3/mm^3$ or more. Stretch-flange formability and fatigue properties are excellent when a number of MnS-based inclusions are precipitated around oxides including one or both of Ce and La, or oxides or oxysulfide including one or both of Ce and La with one or both of Si and Ti contained therein, set as nuclei. Therefore, the upper limit of the volume number density is not particularly limited.

In the same manner as above, the circle equivalent diameter of inclusions where MnS-based inclusions are precipitated on oxides including one or both of Ce and La, or oxides or oxysulfide including one or both of Ce and La with one or both of Si and Ti contained therein is not particularly limited. However, when the circle equivalent diameter is too large, there is concern that the inclusions may be a starting point of cracking, so the upper limit is preferably set to about 50 μm.

When the circle equivalent diameter of the inclusions is less than 1 μm, no problems occur, so the lower limit is not particularly limited.

Next, as a condition of the presence of the extended inclusions in the above-described steel sheet of the present invention, the upper limit of the circle equivalent diameter was defined. Specifically, as a result of the evaluation on the average circle equivalent diameter of inclusions, having a circle equivalent diameter of 1 μm or more and an extension ratio of 5 or more, which become a starting point of cracking and deteriorate stretch-flange formability and fatigue properties, it was found that stretch-flange formability and the fatigue properties are improved when the average circle equivalent diameter of the extended inclusions is equal to or less than 10 μm. Attention was paid to the fact that the average circle equivalent diameter of extended inclusions having a circle equivalent diameter of 1 μm or more and an extension ratio of 5 or more is increased along with the increase in ratio of the number of the inclusions, and the average circle equivalent diameter of the extended inclusions was defined as an indicator. It is estimated that the number of the generated MnS-based inclusions is increased and the generated MnS-based inclusions become coarse in size along with the increase in amount of Mn and S in molten steel.

If extended inclusions, which have a circle equivalent diameter of 1 μm or more and an extension ratio of 5 or more, are large and exceed 10 μm in size, the ratio of the number of the extended inclusions exceeds 20%, so the ratio of the number of the extended coarse MnS-based inclusions which easily become a starting point of cracking is too large and stretch-flange formability and fatigue properties are thus reduced. Accordingly, the average circle equivalent diameter of the extended inclusions having a circle equivalent diameter of 1 μm or more and an extension ratio of 5 or more is set to 10 μm or less.

Regulating the average circle equivalent diameter of extended inclusions having a circle equivalent diameter of 1 μm or more and an extension ratio of 5 or more to be equal to 10 μm or less means that the inclusions having a circle equivalent diameter of 1 μm or more are present in the steel sheet. Accordingly, the lower limit of the circle equivalent diameter is set to 1 μm.

Meanwhile, as a condition of the presence of the inclusions where MnS-based inclusions are precipitated on oxides including one or both of Ce and La, or oxides or oxysulfide including one or both of Ce and La with one or both of Si and Ti contained therein in the above-described steel sheet of the invention, the content of the average composition of Ce or La in the inclusions where the MnS-based inclusions are precipitated is regulated.

Specifically, as described above, in improving stretch-flange formability and fatigue properties, it is important to precipitate MnS-based inclusions on oxides including one or both of Ce and La, or oxides or oxysulfide including one or both of Ce and La with one or both of Si and Ti contained therein and prevent the extension of the MnS-based inclusions.

In the same manner as above, it is preferable that the inclusions have the form where MnS-based inclusions are precipitated on oxides including one or both of Ce and La, or oxides or oxysulfide including one or both of Ce and La with one or both of Si and Ti contained therein. In general, oxides including one or both of Ce and La, or oxides or oxysulfide including one or both of Ce and La with one or both of Si and Ti contained therein are set as nuclei and MnS-based inclusions are precipitated therearound. So, the inclusions are spherical or fusiform.

The fusiform inclusions are not particularly limited. However, the inclusions have an extension ratio of 3 or less, and preferably 2 or less in the steel sheet. Herein, when the inclusions have a completely spherical shape, the extension ratio is 1, so the lower limit of the extension ratio is 1.

Accordingly, in order to clarify the composition effective in suppressing the extension of MnS-based inclusions, the composition of inclusions where MnS-based inclusions are precipitated on oxides including one or both of Ce and La, or oxides or oxysulfide including one or both of Ce and La with one or both of Si and Ti contained therein was analyzed.

If the circle equivalent diameter of the inclusions is equal to or more than 1 μm, the observation is easily performed, so the inclusions having a circle equivalent diameter of 1 μm or more were set as an object for convenience. However, inclusions having a circle equivalent diameter less than 1 μm may be included if they can be observed.

The inclusions where MnS-based inclusions are precipitated on oxides including one or both of Ce and La, or oxides or oxysulfide including one or both of Ce and La with one or both of Si and Ti contained therein are not extended. Therefore, it was confirmed that the extension ratio of all the inclusions is equal to or less than 3. Accordingly, the inclusions having a circle equivalent diameter of 1 μm or more and an extension ratio of 3 or less are employed as an object to perform the composition analysis.

As a result, it was found that stretch-flange formability and fatigue properties are improved if, in average composition, 0.5 to 95% of one or both of Ce and La is contained in the inclusions having a circle equivalent diameter of 1 μm or more and an extension ratio of 3 or less. When the average content of one or both of Ce and La in the inclusions having a circle equivalent diameter of 1 μm or more and an extension ratio of 3 or less is less than 0.5 mass %, the ratio of the number of the inclusions where MnS-based inclusions are precipitated on oxides including one or both of Ce and La, or oxides or oxysulfide including one or both of Ce and La with one or both of Si and Ti contained therein is largely reduced. In accordance with this, the ratio of the number of the extended MnS-based inclusions which easily become a starting point of cracking is too large, so stretch-flange formability and fatigue properties are reduced.

On the other hand, when the average content of one or both of Ce and La in the inclusions having a circle equivalent diameter of 1 μm or more and an extension ratio of 3 or less exceeds 95%, large amounts of cerium oxysulfide and lanthanum oxysulfide are generated and become coarse inclusions having a circle equivalent diameter of about 50 μm or more, so stretch-flange formability and fatigue properties are deteriorated.

Next, the structure of the steel sheet will be described.

In the present invention, by precipitating fine MnS-based inclusions in a cast piece and dispersing the MnS-based inclusions as fine spherical inclusions, which do not undergo deformation in rolling and do not easily become a starting point of cracking, in a steel sheet, stretch-flange formability and fatigue properties are improved. The microstructure of the steel sheet is not particularly limited.

Although the microstructure of the steel sheet is not particularly limited, any of the structures of a steel sheet having bainitic ferrite as a main phase, a composite structure steel sheet having a ferrite phase as a main phase and a martensite phase or a bainite phase as a second phase, and a composite structure steel sheet having ferrite, residual austenite and a low-temperature transformation phase (martensite or bainite) may be employed.

In addition, in the present invention, Ti is essentially added. Accordingly, through sufficient heating of about 1250° C. before hot rolling, carbides, nitrides and carbonitrides generated in casting are solid-soluted and acid-soluble Ti is thus increased in the steel, and then crystal grains can be miniaturized by an effect of carbonitrides of Ti or solid solution Ti. So, the crystal grain size of the structure of the steel sheet can be miniaturized to 10 μm or less.

Accordingly, any structure is preferable, since the crystal grain size can be miniaturized to 10 μm or less and hole expansibility and fatigue properties can thus be improved. If the average grain size exceeds 10 μm, the improvement in ductility and fatigue properties is small. In order to improve hole expansibility and fatigue properties, the crystal grain size is more preferably 8 μm or less. In general, in order to obtain excellent stretch-flange formability for an underbody part, although ductility deteriorates to some extent, it is preferable that the ferrite or bainite phase is the largest phase in terms of area ratio.

Next, producing conditions will be described.

In the present invention, in molten steel which is decarburized by being subjected to blowing in a converter or further decarburized using a vacuum degassing device, alloys such as C, Si and Mn are added and stirred, and the deoxidation and the component adjustment are carried out.

Regarding S, as described above, desulfurization may not be carried out in the refining step, so the desulfurization step may be omitted. However, when molten steel desulfurization is required in secondary refining so as to produce extra-low sulfur steel including 20 ppm or less of S, the desulfurization may be carried out so as to carry out the component adjustment.

After adding Si as described above, Al is added to carry out the Al deoxidation after a lapse of about 3 minutes. It is preferable that floating time of about 3 minutes is ensured to float and separate $Al_2O_3$.

After that, Ti is added and stirring is performed for about 2 to 3 minutes. Then, one or both of Ce and La are added to carry out the component adjustment so that the ratio of (Ce+La)/acid-soluble Al is equal to or more than 0.1 and the ratio of (Ce+La)/S is in the range of 0.4 to 50.

In addition, in a case that a selected element is added, the adding operation is performed before adding one or both of Ce and La. Then, after performing stirring sufficiently, the component adjustment for the selected element is carried out as necessary. Then, one or both of Ce and La are added. The resulting molten steel is continuously cast to produce a cast piece.

Regarding the continuous casting, not only may the invention be applied to continuous casting of slabs of a usual thickness of about 250 mm, but it may also be sufficiently applied to continuous casting of blooms or billets or of thin slabs produced by a slab continuous casting machine with the thickness of a casting mold thinner than usual, for example, 150 mm or less.

Hot rolling conditions for producing a high-strength hot rolled steel sheet will be described.

A heating temperature for a slab before hot rolling is required to solid-solute carbonitrides in steel. For this, it is important that the heating temperature is set to be higher than 1200° C.

By solid-soluting the carbonitrides, a ferrite phase which is preferable in improving ductility is obtained in a cooling step after rolling. Meanwhile, if the heating temperature for the slab before hot rolling exceeds 1250° C., the surface of the slab is markedly oxidized. In particular, wedge-shaped surface defects resulting from the selective oxidation of the grain boundaries remain after descaling. Since the defects reduce the surface quality after rolling, the upper limit is preferably set to 1250° C.

After heating to the above-described temperature range, usual hot rolling is performed. In this step, a finish rolling completion temperature is important for controlling the structure of the steel sheet. If the finish rolling completion temperature is less than $Ar_3$ point+30° C., the crystal grains at a surface layer easily become coarser. This is not preferable for fatigue properties. On the other hand, if the finish rolling completion temperature exceeds $Ar_3$ point+200° C., the austenite grains after rolling become coarser, so the configuration and the fraction of the phase generated during the cooling are hard to control. Accordingly, the upper limit is preferably set to $Ar_3$ point+200° C.

Further, in accordance with the intended structure configuration, a case in which an average cooling rate for the steel sheet after the finish rolling is controlled in the range of 10 to 100° C./second and a winding temperature is controlled in the range of 450 to 650° C., or a case in which after the finish rolling, air-cooling holding is performed at a rate of about 5° C./second up to 680° C. and cooling is then performed at a cooling rate of 30° C./second or more, and a winding temperature is controlled to 400° C. or lower, is selected. By controlling the cooling rate after the rolling and the winding temperature, a steel sheet having one or more structures selected from polygonal ferrite, bainitic ferrite and a bainite phase and a fraction thereof can be obtained under the former rolling condition, and a DP steel sheet, having a composite structure of large amounts of polygonal ferrite phases and martensite phases, which has excellent ductility can be obtained under the latter rolling condition.

When the average cooling rate is less than 10° C./second, perlite is easily generated which is not preferable for stretch-flange formability, so this is not preferable. In controlling the structure, it is not necessary to provide the upper limit of the cooling rate, but there is concern that a too rapid cooling rate leads to the nonuniform cooling of the steel sheet. Moreover, manufacturing a facility enabling such cooling requires a large sum of money, so it is thought that the above facility causes increases in price. From such a viewpoint, the upper limit of the cooling rate is preferably set to 100° C./second.

A high-strength cold rolled steel sheet according to the present invention is produced by carrying out cold rolling and annealing on a steel sheet subjected to hot rolling, winding, pickling and skin pass rolling. The steel sheet is annealed in the annealing step such as batch annealing and continuous annealing to obtain the final cold rolled steel sheet.

Needless to say, the high-strength steel sheet according to the present invention may be applied as a steel sheet for electroplating. The mechanical characteristics of the high-strength steel sheet according to the invention do not change even when being subjected to electroplating.

Examples

Hereinafter, Examples and Comparative Examples of the invention will be described.

Slabs having chemical components shown in Table 1 were hot-rolled under the conditions shown in Table 2 to obtain 3.2-mm thick hot rolled sheets.

[Table 1]

[Table 2]

In Table 1, steel number (hereinafter, referred to as steel No.) 1, 3, 5, 7, 9, 11 and 13 correspond to slabs which are configured to have a structure within the scope of the high-strength steel sheet according to the present invention. Steel Nos. 2, 4, 6, 8, 10, 12 and 14 correspond to slabs which are configured to have, in a mass base, the ratio of (Ce+La)/acid-soluble Al and the ratio of (Ce+La)/S departing from the scope of the high-strength steel sheet according to the present invention.

In addition, in Table 1, in order to compare steel Nos. 1 and 2, steel Nos. 3 and 4, steel Nos. 5 and 6, steel Nos. 7 and 8, steel Nos. 9 and 10, steel Nos. 11 and 12 and steel Nos. 13 and 14, respectively, both of them are configured to have the almost same composition, and different in Ce+La and the like.

In Table 2, in condition A, a heating temperature is set to 1250° C., a finish rolling completion temperature is set to 845° C., a cooling rate after the finish rolling is set to 75° C./second, and a winding temperature is set to 450° C. In condition B, a heating temperature is set to 1250° C., a finish rolling completion temperature is set to 860° C., and air-cooling holding is performed at a rate of about 5° C./second up to 680° C. after the finish rolling. After that, a cooling rate is set to 30° C./second or more and a winding temperature is set to 400° C. In condition C, a heating temperature is set to 1250° C., a finish rolling completion temperature is set to 825° C., a cooling rate after the finish rolling is set to 45° C./second, and a winding temperature is set to 450° C.

The condition A was applied to steel Nos. 1 and 2, the condition B was applied to steel Nos. 3 and 4, and the condition C was applied to steel Nos. 5 and 6, and further, the condition A was applied to steel Nos. 7 and 8, the condition B was applied to steel Nos. 9 and 10, and the condition C was applied to steel Nos. 11, 12, 13 and 14 to compare the influences of the chemical compositions under the same producing condition.

A strength, ductility, stretch-flange formability and a fatigue ratio were examined as basic characteristics of the steel sheets obtained in the manner described above.

In the observation using an optical microscope or the observation using a SEM, inclusions of about 1 μm or more were employed as an object to examine an area number density of the inclusions of 2 μm or less, and a number ratio, a volume number density and an average circle equivalent diameter of the inclusions having an extension ratio of 5 or more as a state of the presence of the extended inclusions in the steel sheets.

In addition, inclusions of about 1 μm or more were employed as an object to examine a number ratio and a volume number density of the inclusions where MnS-based inclusions are precipitated on oxides including one or both of Ce and La, or oxides or oxysulfide including one or both of Ce and La with one or both of Si and Ti contained therein, and an average value of the content of one or both of Ce and La in the inclusions having an extension ratio of 3 or less as a state of the presence of the unextended inclusions in the steel sheets.

The reason the inclusions of about 1 μm or more were employed as an object is that they are easily observed and inclusions less than about 1 μm do not have an influence on the deterioration of stretch-flange formability and fatigue properties The results are shown in Table 3 for each combination of the steel and the rolling condition.

[Table 3]

The strength and the ductility were obtained by a tensile test performed on a JIS No. 5 test piece taken in parallel with a direction of the rolling. The stretch-flange formability was evaluated by pushing and expanding a punched hole of a diameter of 10 mm formed at the center of a steel sheet of 150 mm×150 mm with the use of a 60°-conical punch, measuring a hole diameter D (mm) at the time when a crack passing through a thickness of the sheet occurs, and obtaining a hole expansion value λ equal to (D−10)/10. The fatigue ratio which is used as an indicator indicating fatigue properties was evaluated by a value (σW/σB) which is obtained by dividing a time strength of $2\times10^6$ (σW), obtained by a method based on JIS Z 2275, by a strength (σB) of the steel sheet.

The test piece is a No. 1 test piece defined by the same standard. The test piece used has a parallel part of 25 mm, a radius of curvature R of 100 mm, and a thickness after equally grinding both sides of the original sheet (hot rolled sheet) of 3.0 mm.

The inclusions were observed using an SEM, and long and short axes of 50 inclusions, randomly selected and having a circle equivalent diameter of 1 μm or more, were measured. Further, the 50 inclusions, randomly selected and having a circle equivalent diameter of 1 μm or more, were subjected to the composition analysis by using a quantitative analysis function of the SEM. By using the results, a number ratio of the inclusion having an extension ratio of 5 or more, and an average circle equivalent diameter of the inclusions having an extension ratio of 5 or more, a number ratio of the inclusions where MnS-based inclusions are precipitated on oxides including one or both of Ce and La, or oxides or oxysulfide including one or both of Ce and La with one or both of Si and Ti contained therein, and an average value of one or both of Ce and La in the inclusions having an extension ratio of 3 or less were obtained. A volume number density for each of the forms of the inclusions was calculated by the SEM evaluation of an electrolyzed surface with the use of a speed method.

As is obvious from Table 3, in the steel Nos. 1, 3, 5, 7, 9, 11 and 13 to which the method of the invention was applied, it was possible to reduce the extended MnS-based inclusions in the steel sheet by precipitating the MnS-based inclusions on oxides including one or both of Ce and La, or oxides or oxisulfide including one or both of Ce and La with one or both of Si and Ti contained therein. That is, by controlling a number density of the inclusions, having a circle equivalent diameter of 2 μm or less, which are present in the steel sheet to $15/mm^2$ or more, controlling a number density of the inclusions where MnS-based inclusions are precipitated on oxides including one or both of Ce and La, or oxides or oxysulfide including one or both of Ce and La with one or both of Si and Ti contained therein to 10% or more, controlling a volume number density of the inclusions to $1.0\times10^3/mm^3$, and controlling an average content of one or both of Ce and La in the inclusions, having an extension ratio of 3 or less, which are present in the steel sheet to 0.5 to 50%, it was possible to control the ratio of the number of the inclusions, having a circle equivalent diameter of 1 μm or more and an extension ratio of 5 or more, to 20% or less, control the volume number density of the inclusions to $1.0\times10^4/mm^3$ or less, and control the average circle equivalent diameter of the inclusions to 10 μm or less. In the structure of any of the steel sheets, the average crystal grain size was in the range of 1 to 8 μm. Almost the same average crystal grain diameter was shown in Examples according to the present invention and Comparative Examples.

As a result, in the case of steel Nos. 1, 3, 5, 7, 9, 11 and 13 as the steel sheets of the present invention, it was possible to obtain the steel sheets having more excellent stretch-flange formability and fatigue properties than in the comparative steel sheets. However, in the case of the comparative steel sheets (Steel Nos. 2, 4, 6, 8, 10, 12 and 14), although an average crystal grain size was 10 μm or less in any steel sheet, the distribution state of the extended MnS-based inclusions and the inclusions where MnS-based inclusions are precipitated one oxides including one or both of Ce and La, or oxides and oxysulfide including one or both of Ce and La with one or both of Si and Ti contained therein was different from the distribution state defined in the present invention. Accordingly, the MnS-based inclusions extended in the steel sheet processing became a starting point of cracking and stretch-flange formability and fatigue properties were thus reduced.

INDUSTRIAL APPLICABILITY

In a high-strength steel sheet according to the present invention, by the Al deoxidation, the adjustment of components in molten steel is stabilized, the generation of coarse alumina inclusions is suppressed and fine MnS-based inclusions are precipitated in a cast piece. So, the fine spherical inclusions, which do not undergo deformation in rolling and do not easily become a starting point of cracking, can be dispersed in the steel sheet. In addition, it is possible to make crystal grains in the structure fine and improve stretch-flange formability and fatigue properties.

Moreover, in a method of producing molten steel for the above-described high-strength steel sheet according to the present invention, by the Al deoxidation, the adjustment of components in the molten steel is stabilized, the generation of coarse alumina inclusions can be suppressed and fine MnS-based inclusions are precipitated in the cast piece. So, the fine spherical inclusions, which do not undergo deformation in rolling and do not easily become a starting point of cracking, can be dispersed in the steel sheet. In addition, it is possible to make crystal grains in the structure fine and obtain a high-strength hot rolled steel sheet having excellent stretch-flange formability and fatigue properties.

TABLE 1

| | Steel No. | C | Si | Mn | P | S | N | Acid-soluble Al | Acid-soluble Ti | Cr | Nb |
|---|---|---|---|---|---|---|---|---|---|---|---|
| Example 1 | 1 | 0.06 | 0.68 | 1.38 | 0.01 | 0.004 | 0.002 | 0.028 | 0.026 | | |
| Comparative example 1 | 2 | 0.06 | 0.69 | 1.38 | 0.01 | 0.004 | 0.0021 | 0.028 | 0.026 | | |
| Example 2 | 3 | 0.06 | 0.68 | 1.38 | 0.01 | 0.001 | 0.002 | 0.028 | 0.025 | | |
| Comparative example 2 | 4 | 0.06 | 0.69 | 1.38 | 0.01 | 0.001 | 0.0021 | 0.028 | 0.025 | | |
| Example 3 | 5 | 0.06 | 0.2 | 1.5 | 0.015 | 0.01 | 0.0022 | 0.033 | 0.02 | | |
| Comparative example 3 | 6 | 0.06 | 0.2 | 1.5 | 0.015 | 0.01 | 0.0023 | 0.032 | 0.02 | | |
| Example 4 | 7 | 0.06 | 0.68 | 1.38 | 0.01 | 0.004 | 0.002 | 0.028 | 0.026 | | 0.02 |
| Comparative example 4 | 8 | 0.06 | 0.69 | 1.38 | 0.01 | 0.004 | 0.0021 | 0.028 | 0.026 | | 0.02 |
| Example 5 | 9 | 0.06 | 0.68 | 1.38 | 0.01 | 0.001 | 0.002 | 0.028 | 0.025 | 0.03 | |
| Comparative example 5 | 10 | 0.06 | 0.69 | 1.38 | 0.01 | 0.001 | 0.0021 | 0.028 | 0.025 | 0.03 | |
| Example 6 | 11 | 0.06 | 0.2 | 1.5 | 0.015 | 0.01 | 0.0022 | 0.033 | 0.02 | | |
| Comparative example 6 | 12 | 0.06 | 0.2 | 1.5 | 0.015 | 0.01 | 0.0023 | 0.032 | 0.02 | | |
| Example 7 | 13 | 0.1 | 0.25 | 2 | 0.01 | 0.003 | 0.002 | 0.03 | 0.02 | 0.03 | 0.03 |
| Comparative example 7 | 14 | 0.1 | 0.25 | 2 | 0.01 | 0.003 | 0.0021 | 0.03 | 0.02 | 0.03 | 0.03 |

| | V | Mo | Zr | B | Ca | Ce | La | (Ce + La)/Acid-soluble Al | (Ce + La)/S |
|---|---|---|---|---|---|---|---|---|---|
| Example 1 | | | | | | 0.0028 | | 0.1 | 0.7 |
| Comparative example 1 | | | | | | | | | |
| Example 2 | | | | | | 0.03 | 0.02 | 1.8 | 50 |
| Comparative example 2 | | | | | | 0.0025 | | 0.09 | 2.5 |
| Example 3 | | | | | | | 0.004 | 0.12 | 0.4 |
| Comparative example 3 | | | | | | | 0.003 | 0.09 | 0.3 |
| Example 4 | | | | | | 0.0028 | | 0.1 | 0.7 |
| Comparative example 4 | | | | | | | | | |
| Example 5 | | | | | | 0.03 | 0.02 | 1.8 | 50 |
| Comparative example 5 | | | | | | 0.0025 | | 0.09 | 2.5 |
| Example 6 | | | | | 0.001 | | 0.004 | 0.12 | 0.4 |
| Comparative example 6 | | | | | 0.001 | | 0.003 | 0.09 | 0.3 |

TABLE 1-continued

| | | | | | | | | | |
|---|---|---|---|---|---|---|---|---|---|
| Example 7 | 0.02 | 0.15 | 0.005 | 0.002 | 0.0015 | 0.045 | 0.03 | 2.5 | 25 |
| Comparative example 7 | 0.02 | 0.15 | 0.005 | 0.002 | 0.0015 | 0.0007 | 0.0004 | 0.04 | 0.37 |

The underline indicates that the underlined value is not in the condition defined in the invention.

TABLE 2

| Condition | Heating temperature (° C.) | Finish rolling completion temperature (° C.) | Cooling rate after finish rolling (° C./second) | Winding temperature (° C.) | Steel No. of processing object |
|---|---|---|---|---|---|
| A | 1250 | 845 | 75 | 450 | 1, 2, 7, 8 |
| B | 1250 | 860 | 30 | 400 | 3, 4, 9, 10 |
| C | 1250 | 825 | 45 | 450 | 5, 6, 11~14 |

TABLE 3

| | Steel No. | Condition | Strength (MPa) | Ductility (%) | Area number density of inclusions having circle equivalent diameter of 2 μm or less (inclusions/mm$^2$) | Ratio of number of inclusions, having circle equivalent diameter of 1 μm or more, where MnS-based inclusions are precipitated on oxides including one or both of Ce and La, or oxides or oxysulfide including one or both of Ce and La with one or both of Si and Ti contained therein (%) | Ratio of number of inclusions having circle equivalent diameter of 1 μm or more and extension ratio of 5 or more (%) |
|---|---|---|---|---|---|---|---|
| Example 1 | 1 | A | 605 | 25 | 25 | 83 | 6 |
| Comparative example 1 | 2 | A | 605 | 25 | 4 | 0 | 95 |
| Example 2 | 3 | B | 605 | 27 | 35 | 87 | 0 |
| Comparative example 2 | 4 | B | 605 | 27 | 14 | 0 | 97 |
| Example 3 | 5 | C | 497 | 22 | 15 | 80 | 5 |
| Comparative example 3 | 6 | C | 495 | 19 | 1 | 0 | 85 |
| Example 4 | 7 | A | 605 | 25 | 24 | 83 | 6 |
| Comparative example 4 | 8 | A | 605 | 25 | 3 | 0 | 95 |
| Example 5 | 9 | B | 605 | 27 | 36 | 87 | 0 |
| Comparative example 5 | 10 | B | 605 | 27 | 13 | 0 | 97 |
| Example 6 | 11 | C | 497 | 22 | 16 | 80 | 5 |
| Comparative example 6 | 12 | C | 495 | 19 | 1 | 0 | 85 |
| Example 7 | 13 | C | 1005 | 17 | 28 | 86 | 5 |
| Comparative example 7 | 14 | C | 995 | 16 | 3 | 1 | 96 |

TABLE 3-continued

| | Volume number density of inclusions, having circle equivalent diameter of 1 μm or more, where MnS-based inclusions are precipitated on oxides including one or both of Ce and La, or oxides or oxysulfide including one or both of Ce and La with one or both of Si and Ti contained therein (inclusions/mm$^3$) | Volume number density of inclusions having circle equivalent diameter of 1 μm or more and extension ratio of 5 or more (inclusions/mm$^3$) | Average content of one or both of Ce and La in inclusions having circle equivalent diameter of 1 μm or more and extension ratio of 3 or less (%) | Average circle equivalent diameter of inclusions having circle equivalent diameter of 1 μm or more and extension ratio of 5 or more (μm) | Hole expansion value λ | Fatigue ratio (σW/σB) |
|---|---|---|---|---|---|---|
| Example 1 | $8.8 \times 10^4$ | 0 | 31 | 4 | 92 | 0.68 |
| Comparative example 1 | 0 | $9.3 \times 10^4$ | 0 | 19 | 37 | 0.58 |
| Example 2 | $9.5 \times 10^4$ | 0 | 48 | 3 | 162 | 0.69 |
| Comparative example 2 | 0 | $9.4 \times 10^4$ | 0 | 20 | 33 | 0.57 |
| Example 3 | $6.1 \times 10^4$ | $4.1 \times 10^3$ | 10 | 7 | 125 | 0.6 |
| Comparative example 3 | 0 | $7.0 \times 10^4$ | 0 | 22 | 75 | 0.46 |
| Example 4 | $8.8 \times 10^4$ | 0 | 31 | 4 | 91 | 0.67 |
| Comparative example 4 | 0 | $9.3 \times 10^4$ | 0 | 19 | 35 | 0.58 |
| Example 5 | $9.5 \times 10^4$ | 0 | 48 | 3 | 168 | 0.7 |
| Comparative example 5 | 0 | $9.4 \times 10^4$ | 0 | 20 | 31 | 0.57 |
| Example 6 | $6.1 \times 10^4$ | $4.1 \times 10^3$ | 10 | 7 | 125 | 0.61 |
| Comparative example 6 | 0 | $7.0 \times 10^4$ | 0 | 22 | 74 | 0.46 |
| Example 7 | $9.7 \times 10^4$ | $5.9 \times 10^3$ | 31 | 4 | 84 | 0.63 |
| Comparative example 7 | $8.2 \times 10^2$ | $9.4 \times 10^4$ | 0.4 | 24 | 30 | 0.44 |

The invention claimed is:

1. A steel sheet comprising:

0.03 to 0.20% of C, 0.20 to 1.5% of Si, 0.5 to 3.0% of Mn, 0.05% or less of P, 0.0005% or more of S, 0.008 to 0.026% of acid-soluble Ti, 0.0005 to 0.01% of N, more than 0.01% of acid-soluble Al, and 0.001 to 0.04% of one or both of Ce and La in terms of mass %; and a balance including Fe and inevitable impurities, wherein a ratio of (Ce+La)/acid-soluble Al is equal to or more than 0.1 and a ratio of (Ce+La)/S is in a range of 0.4 to 50 in a mass base, and wherein a density of a number of inclusions, having a circle equivalent diameter of 2 μm or less, which are present in the steel sheet is equal to or more than 15/mm$^2$.

2. A steel sheet comprising:

0.03 to 0.20% of C, 0.20 to 1.5% of Si, 0.5 to 3.0% of Mn, 0.05% or less of P, 0.0005% or more of S, 0.008 to 0.026% of acid-soluble Ti, 0.0005 to 0.01% of N, more than 0.01% of acid-soluble Al, and 0.001 to 0.04% of one or both of Ce and La in terms of mass %; and a balance including Fe and inevitable impurities, wherein a ratio of (Ce+La)/acid-soluble Al is equal to or more than 0.1 and a ratio of (Ce+La)/S is in a range of 0.4 to 50 in a mass base, and wherein extended inclusions having a circle equivalent diameter of 1 μm or more and a ratio of long axis/short axis of 5 or more are in an amount of equal to or less than 20% of inclusions having a circle equivalent diameter of 1 μm or more.

3. A steel sheet comprising:

0.03 to 0.20% of C, 0.20 to 1.5% of Si, 0.5 to 3.0% of Mn, 0.05% or less of P, 0.0005% or more of S, 0.008 to 0.026% of acid-soluble Ti, 0.0005 to 0.01% of N, more than 0.01% of acid-soluble Al, and 0.001 to 0.04% of one or both of Ce and La in terms of mass %; and a balance including Fe and inevitable impurities, wherein a ratio of (Ce+La)/acid-soluble Al is equal to or more than 0.1 and a ratio of (Ce+La)/S is in a range of 0.4 to 50 in a mass base, and wherein in the steel sheet, inclusions where at least one of MnS, TiS or (Mn, Ti)S is compositely precipitated on oxides including one or both of Ce and La, or oxides or oxysulfide including one or both of Ce and La with one or both of Si and Ti contained therein are in an amount of 10% or more of inclusions having a circle equivalent diameter of 1 μm or more.

4. A steel sheet comprising:

0.03 to 0.20% of C, 0.20 to 1.5% of Si, 0.5 to 3.0% of Mn, 0.05% or less of P, 0.0005% or more of S, 0.008 to 0.026% of acid-soluble Ti, 0.0005 to 0.01% of N, more than 0.01% of acid-soluble Al, and 0.001 to 0.04% of one or both of Ce and La in terms of mass %; and a balance including Fe and inevitable impurities, wherein a ratio of (Ce+La)/acid-soluble Al is equal to or more than 0.1 and a ratio of (Ce+La)/S is in a range of 0.4 to 50 in a mass base, and wherein a volume number density of extended inclusions, having a circle equivalent diameter of 1 μm or more and a ratio of long axis/short axis of 5 or more, which are present in the steel sheet is equal to or less than $1.0\times10^4/mm^3$.

5. A steel sheet comprising:

0.03 to 0.20% of C, 0.20 to 1.5% of Si, 0.5 to 3.0% of Mn, 0.05% or less of P, 0.0005% or more of S, 0.008 to 0.026% of acid-soluble Ti, 0.0005 to 0.01% of N, more than 0.01% of acid-soluble Al, and 0.001 to 0.04% of one or both of Ce and La in terms of mass %; and a balance including Fe and inevitable impurities, wherein a ratio of (Ce+La)/acid-soluble Al is equal to or more than 0.1 and a ratio of (Ce+La)/S is in a range of 0.4 to 50 in a mass base, and wherein in the steel sheet, a volume number density of inclusions, where at least one of MnS, TiS or (Mn, Ti)S is compositely precipitated on oxides including one or both of Ce and La, or oxides or oxysulfide including one or both of Ce and La with one or both of Si and Ti contained therein, is equal to or more than $1.0\times10^3/mm^3$.

6. A steel sheet comprising:

0.03 to 0.20% of C, 0.20 to 1.5% of Si, 0.5 to 3.0% of Mn, 0.05% or less of P, 0.0005% or more of S, 0.008 to 0.026% of acid-soluble Ti, 0.0005 to 0.01% of N, more than 0.01% of acid-soluble Al, and 0.001 to 0.04% of one or both of Ce and La in terms of mass %; and a balance including Fe and inevitable impurities, wherein a ratio of (Ce+La)/acid-soluble Al is equal to or more than 0.1 and a ratio of (Ce+La)/S is in a range of 0.4 to 50 in a mass base, and wherein an average circle equivalent diameter of extended inclusions, having a circle equivalent diameter of 1 μm or more and a ratio of long axis/short axis of 5 or more, which are present in the steel sheet is equal to or less than 10 μm.

7. A steel sheet comprising:

0.03 to 0.20% of C, 0.20 to 1.5% of Si, 0.5 to 3.0% of Mn, 0.05% or less of P, 0.0005% or more of S, 0.008 to 0.026% of acid-soluble Ti, 0.0005 to 0.01% of N, more than 0.01% of acid-soluble Al, and 0.001 to 0.04% of one or both of Ce and La in terms of mass %; and a balance including Fe and inevitable impurities, wherein a ratio of (Ce+La)/acid-soluble Al is equal to or more than 0.1 and a ratio of (Ce+La)/S is in a range of 0.4 to 50 in a mass base, and wherein an average crystal grain size of a structure of the steel sheet is equal to or less than 10 μm.

8. The steel sheet according to any one of claims 1-6 and 7, further comprising:

one or both of 0.01 to 0.10% of Nb and 0.01 to 0.05% of V in terms of mass %.

9. The steel sheet according to claim 8, further comprising:

at least one of 0.01 to 0.6% of Cr, 0.01 to 0.4% of Mo or 0.0003 to 0.003% of B in terms of mass %.

10. The steel sheet according to claim 9, further comprising:

one or both of 0.0001 to 0.004% of Ca and 0.001 to 0.01% of Zr in terms of mass %.

11. A method of producing a molten steel for the steel sheet according to any one of claims 1 to 6 and 7, the method comprising:

performing an adding or adjusting operation so that 0.03 to 0.20% of C, 0.20 to 1.5% of Si, 0.5 to 3.0% of Mn and 0.0005 to 0.01% of N are present in the molten steel which is processed to contain 0.05% or less of P and 0.0005% or more of S;

after performing the adding or adjusting operation, adding Al so that more than 0.01% of acid-soluble Al is present;

after performing the adding of Al, adding Ti; and after performing the adding of Ti, adding one or both of Ce and La so that 0.008 to 0.026% of acid-soluble Ti and 0.001 to 0.04% of one or both of Ce and La are present in terms of mass % in a refining step in steel making, wherein a ratio of (Ce+La)/acid-soluble Al is equal to or more than 0.1 and a ratio of (Ce+La)/S is in a range of 0.4 to 50 in a mass base.

12. The method according to claim 11, further comprising:

performing an adding operation before adding one or both of Ce and La so that one or both of 0.01 to 0.10% of Nb and 0.01 to 0.05% of V are present in terms of mass % in the refining step.

13. The method according to claim 12, further comprising:

performing an adding operation before adding one or both of Ce and La so that at least one of 0.01 to 0.6% of Cr, 0.01 to 0.4% of Mo or 0.0003 to 0.003% of B are present in terms of mass % in the refining step.

14. The method according to claim 13, further comprising:

performing an adding operation before adding one or both of Ce and La so that one or both of 0.0001 to 0.004% of Ca and 0.001 to 0.01% of Zr are present in terms of mass % in the refining step.

* * * * *